US007201111B1

(12) United States Patent
Burkett

(10) Patent No.: US 7,201,111 B1
(45) Date of Patent: Apr. 10, 2007

(54) BOAT HULLS WITH PLANING SECTIONS

(76) Inventor: Jerry D. Burkett, 211 El Dorado Dr., Richmond, VA (US) 23229

( * ) Notice: Subject to any disclaimer, the term of this patent is extended or adjusted under 35 U.S.C. 154(b) by 0 days.

(21) Appl. No.: 11/143,521

(22) Filed: Jun. 2, 2005

Related U.S. Application Data

(63) Continuation-in-part of application No. 10/308,363, filed on Dec. 3, 2002.

(51) Int. Cl.
*B63B 1/00* (2006.01)
*B63B 1/32* (2006.01)

(52) U.S. Cl. ..... 114/271; 114/291

(58) Field of Classification Search ..... 114/271, 114/251, 291
See application file for complete search history.

(56) References Cited

U.S. PATENT DOCUMENTS 2,423,860 A * 7/1947 Patten ..... 114/291
3,237,581 A 3/1966 Moesly
4,004,542 A 1/1977 Holmes
4,022,143 A 5/1977 Krenzler
4,128,072 A 12/1978 Wood, Jr.
4,231,314 A 11/1980 Peters
4,233,920 A 11/1980 Wood et al.
4,453,489 A 6/1984 Charlins
4,465,009 A 8/1984 Wood et al.
4,492,176 A 1/1985 Arima
4,584,959 A 4/1986 Allison
4,619,215 A 10/1986 Wood et al.
4,672,905 A 6/1987 Pipkorn
4,726,310 A 2/1988 Ard et al.
4,958,585 A 9/1990 Caldwell, Jr.
5,046,439 A 9/1991 Goodson et al.
5,063,868 A 11/1991 Fink, Jr.
5,215,025 A 6/1993 Talmor
5,390,624 A 2/1995 Barnes
5,419,274 A 5/1995 van Diepen (Continued)

OTHER PUBLICATIONS

Clement, E.P., "Graphs for Predicting the Ideal High-Speed Resistance of Planing Catamarans," Department of the Navy, David Taylor Model Basin, Hydromechanics Laboratory Resesarch and Development Report 1573, Nov. 1961, pp. 1-30.

(Continued)

*Primary Examiner*—Jesús D. Sotello
(74) *Attorney, Agent, or Firm*—Leading-Edge Law Group, PLC; James T. Beran

(57) ABSTRACT

Boat hulls or assemblies have sequences of groups of downward-facing sections such as planing sections. A sequence includes a lowermost group and supplemental groups above it. Each group could, for example, be a pair, and the pairs could be port-starboard symmetrical. The lower surface is shaped so that the boat hull, in a series of speed ranges, planes on successively lower groups, planing on the lowermost group in the highest range. The trim angle can be between 3.0° and 6.0° in a speed range. The boat hull can be structured so that, when planing on one of the groups, the next higher group dries out. For example, each pair of sections can have an outward angle not smaller than the next inward pair's. The lowermost group can have a maximum width approximately equal to an ideal beam width for a set of displacement characteristics and its target maximum speed.

34 Claims, 9 Drawing Sheets

U.S. PATENT DOCUMENTS

| | | | |
|---|---|---|---|
| 5,443,026 | A | 8/1995 | Wenstadt et al. |
| 5,685,253 | A | 11/1997 | Alexander, Jr. |
| 5,983,823 | A | 11/1999 | Allison |
| 6,176,196 | B1 | 1/2001 | Halter |

OTHER PUBLICATIONS

Clement, E.P., "How to Use the SNAME Small Craft Data Sheets for Design and for Resistance Prediction," The Society of Naval Architects and Marine Engineers, Technical and Research Bulletin No. 1-23, May 1963, pp. 1-23 and attached figures and data sheets.

Clement, E.P., "Resistance Tests of a Systematic Series of Planing Hull Forms," The Society of Naval Architects and Marine Engineers, Nov. 1963, pp. 1-71.

Savitsky, D., "Hydrodynamic Design of Planing Hulls," Society of Naval Architects & Marine Engineers, Oct. 1964, pp. 71-95.

Teale, J., "High Speed Power Boats," Westlawn Institute of Marine Technology, 1988, pp. 1-31.

Lewis, E.V., "Principles of Naval Architecture, Second Revision," The Society of Naval Architects and Marine Engineers, 1988, pp. 99-105.

Blount, D.L., and Blount, D., "Powerboat Performance Tests," Professional BoatBuilder, Oct./Nov. 2002, pp. 68-75.

* cited by examiner

BOAT HULLS WITH PLANING SECTIONS

CROSS-REFERENCE TO RELATED APPLICATIONS

This application claims priority as a continuation-in-part of co-pending U.S. patent application Ser. No. 10/308,363 ("the Parent Application"), filed Dec. 3, 2002, entitled "Planing Power Boat" and hereby incorporated by reference in its entirety. This application also incorporates by reference in its entirety U.S. Patent Application Publication No. 2004/0103836 ("the Parent Publication").

BACKGROUND OF THE INVENTION

The present invention relates generally to boat hulls. More particularly, the present invention relates to boat hulls capable of planing.

As used herein, a boat hull "planes" or is a "planing boat hull" if it is capable of at least partially skimming across a water surface when propelled in a range of its normal operating speeds. In other words, as the boat hull increases from rest to its maximum operating speed, it makes a transition so that part of the hull that was submerged at rest has instead been lifted higher and approximately parallel to the water's surface.

More formally, planing can be defined in terms of vertical displacement of a boat's center of gravity relative to its rest level, also referred to as "vertical center of gravity" or "VCOG". The center of gravity's position at rest is determined solely by hull buoyancy. As a boat accelerates bowward, VCOG at first drops, in part because the hull loses buoyancy due to wave action and other forces. In the case of a planing boat with a relatively flat lower surface, further acceleration causes VCOG to rise because the lower surface provides lift from dynamic forces. In this approach, planing is defined as beginning at the speed at which VCOG has been restored to its rest level.

Various planing boat hulls have been proposed, including boat hulls for racing, military purposes, and sport boating. One characteristic of many such hulls is a "V-bottom hull", in which a center section of the hull's lower surface has a V shape. Many variations of V-bottom hulls have been proposed.

U.S. Pat. No. 3,237,581 describes a boat hull with a V-shaped bottom that meets each topside at a hard chine. The bottom surface includes a series of vertically stepped generally horizontal planing surfaces connected by longitudinally running, substantially vertical risers that are substantially parallel to the center line. Each planing surface has less dead rise than the next inboard planing surface and more dead rise than the next outboard planing surface. At slow, displacement speed, water parts at the bow and flows along the bottom, but as speed is increased, the bow shape imparts dynamic lift to the hull and its non-vertical surfaces. As speed increases further, the inboard planing surfaces begin to support the weight of the boat without the full assistance of the outboard planing surfaces. At high speed the outboard planing surfaces may rise out of contact with the water, the boat being supported only on the more inboard planing surfaces, which direct the flow of water resulting from contact.

U.S. Pat. Nos. 4,128,072; 5,983,823; and 6,176,196 are examples of the wide variety of other boat hull techniques that have been proposed. In general, these techniques involve modifying a planing boat hull in some way to achieve a desired result. For example, the ratio of length to beam can be increased.

It would be advantageous to have improved boat hull techniques. More particularly, it would be advantageous to have boat hulls permitting improved fuel efficiency and offering better performance when driven at lower power.

SUMMARY OF THE INVENTION

The invention provides various embodiments, including boat hulls, boat hull assemblies, boats, and methods. In general, each embodiment includes a sequence of pairs or other groups of sections on which planing can occur.

These and other features and advantages of exemplary embodiments of the invention are described below with reference to the accompanying drawings.

DETAILED DESCRIPTION

Figure 1:
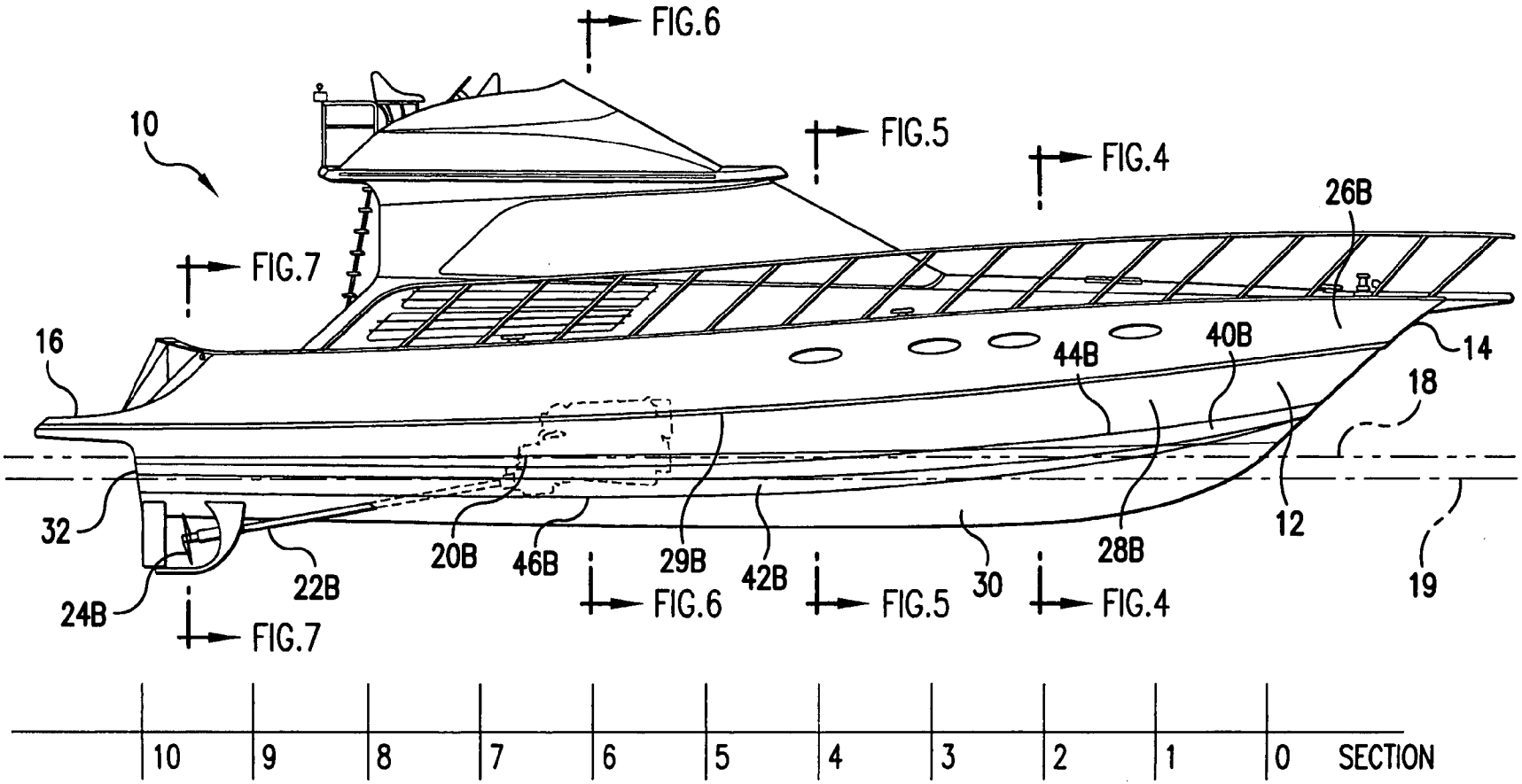
FIG. 1 is a side profile view of an implementation of a boat having a monohull with two groups of bottom planing sections.

In the following detailed description, numeric ranges are provided for various aspects of the implementations described. These recited ranges are to be treated as examples only, and are not intended to limit the scope of the claims. In addition, a number of materials are identified as suitable for various facets of the implementations. These recited materials are to be treated as exemplary, and are not intended to limit the scope of the claims.

A boat hull is treated herein as including a "hull body", meaning the part of the boat hull with a surface that receives buoyancy and lift from water during normal operation. The surface of a hull body that contacts the water and receives buoyancy and lift is referred to herein as a "lower surface." A hull body has bow and stern ends between which the lower surface extends in a lengthwise direction, and parts of the lower surface that extend in the same direction are "lengthwise-extending." A hull body is "oblong" if its length between its bow and stern ends is greater than the lower surface's width.

In addition, a hull body's lower surface is "substantially port-starboard symmetrical" in a particular cross section, such as a cross section perpendicular to a hull body's length, if the cross section is substantially symmetrical about a vertical axis of symmetry; the vertical axis of symmetry may lie in a boat hull's "center plane." A "water-contacting cross section" is a cross section of a hull body that includes part of the lower surface that contacts water and receives buoyancy and lift during normal operation.

A hull body's lower surface typically includes a number of "sections", where each section may have a visible boundary around it, such as a chine or other line or intersection at which it meets another section. In general, the division of a hull's lower surface into sections is somewhat arbitrary, and the term "section", as used herein, does not limit each section to a particular structure or manufacturing process, but only refers to the fact that it is part of the lower surface.

Sections and other features of hull bodies have the following directional orientation in the description below: A vertical direction away from or out of the surface of the water is "up", "over", or "above", while a direction toward or into the water surface is "down", "under", or "below." The lowermost part of a hull body is referred to as the "bottom" and a port-starboard symmetrical lower surface often has a "center-line" at its bottom. A horizontal direction, on the other hand, is "bowward" if toward a hull's bow and "outward" if away from a hull's center plane, center-line, or other lengthwise-extending center portion.

As used herein, a section extends "outward" or is "outward-extending" if it extends laterally away from the center plane, center-line, or other lengthwise-extending center or inner portion of the lower surface. An outward-extending section of a lower surface, when viewed in cross section, has an "outward angle" at which it extends outward, and the outward angle is measured upward or downward from horizontal. The outward angle is "above horizontal" if the section rises as it extends outward, in which case the outward angle is also referred to as "deadrise". Similarly, the "inner periphery" of an outward-extending section is the side disposed toward the center plane or center-line while the "outer periphery" is the side disposed away. The section's "width" can, for example, be the horizontal displacement between its inner and outer peripheries along a line perpendicular to the center plane.

A non-horizontal section faces "outward" or is "outward-facing" if it is exposed away from a boat hull's center plane, center-line, or other lengthwise-extending center portion. For example, a vertical section that extends upward from the outer periphery of one lengthwise- and outward-extending section to the inner periphery of another would ordinarily face outward.

A non-vertical section faces "downward" or is "downward-facing" if it is exposed toward the water. Where a lower surface has more than one group of downward-facing sections, the groups can be treated as a sequence as described below, with the "lowermost group" being deepest in the water and with other groups being above the lowermost group. A group may, of course, include only one section, such as a central section at a hull's bottom.

The term "chine" is used herein to refer to a line or similar intersection where a downward-facing section meets an outward-facing section, especially in cases in which the downward-facing section contacts water during planing.

A port-starboard symmetrical lower surface often has a "V-shaped" central bottom section, meaning that the central bottom section extends outward and upward from the center-line in the shape of a V. The two sides of the V-shape are referred to herein as "V-arms," and each V-arm may be treated as a separate section in some contexts.

Figure 2:
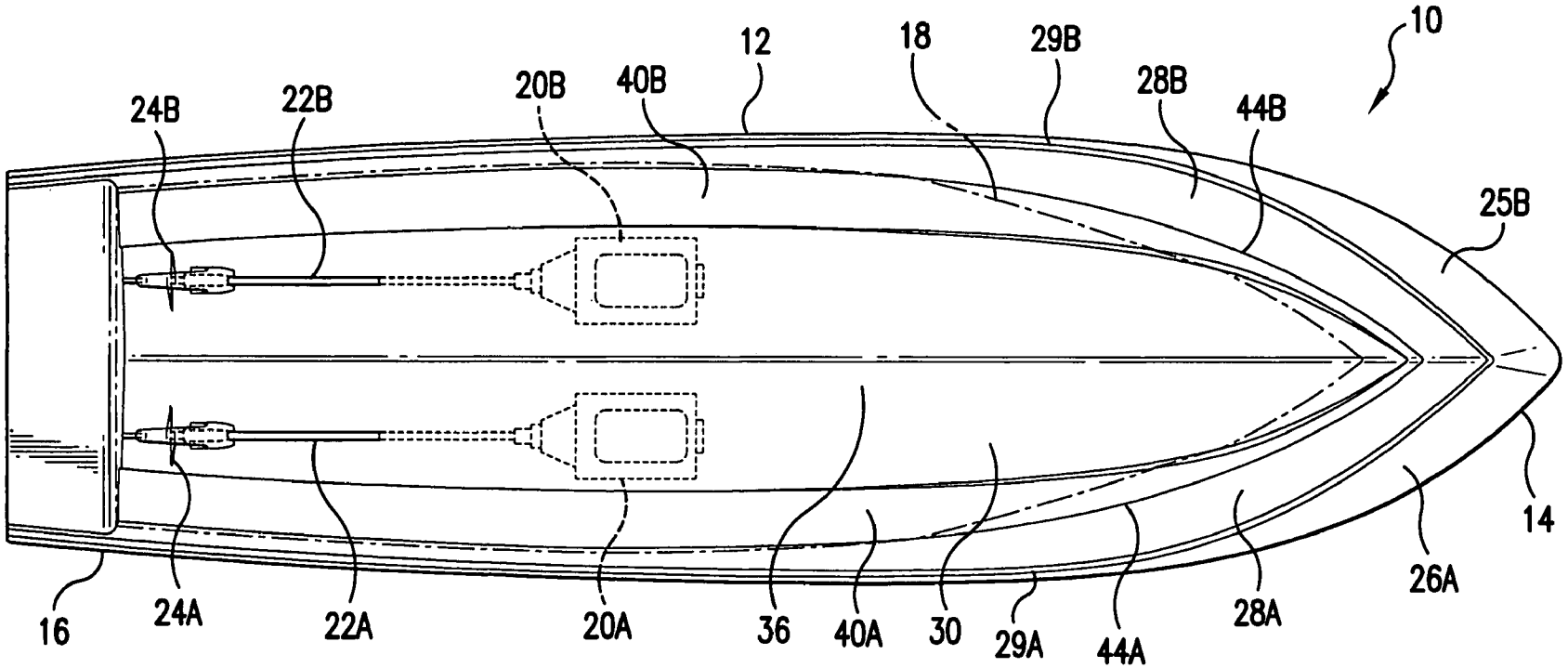
FIG. 2 shows a bottom plan view looking upward from beneath the boat shown in FIG. 1.

Boat 10 in FIG. 1 has a single hull (or "monohull") 12 with bow 14 and stern 16. It is designed to float at waterline 18 when at rest and to rise to waterline 19 as it approaches its top design speed. FIG. 2 shows boat 10 from below, with a pair of engines 20A and 20B mounted in hull 12 to drive a pair of shafts 22A and 22B and propellers 24A and 24B (A and B indicating port and starboard components, respectively).

Figure 3:
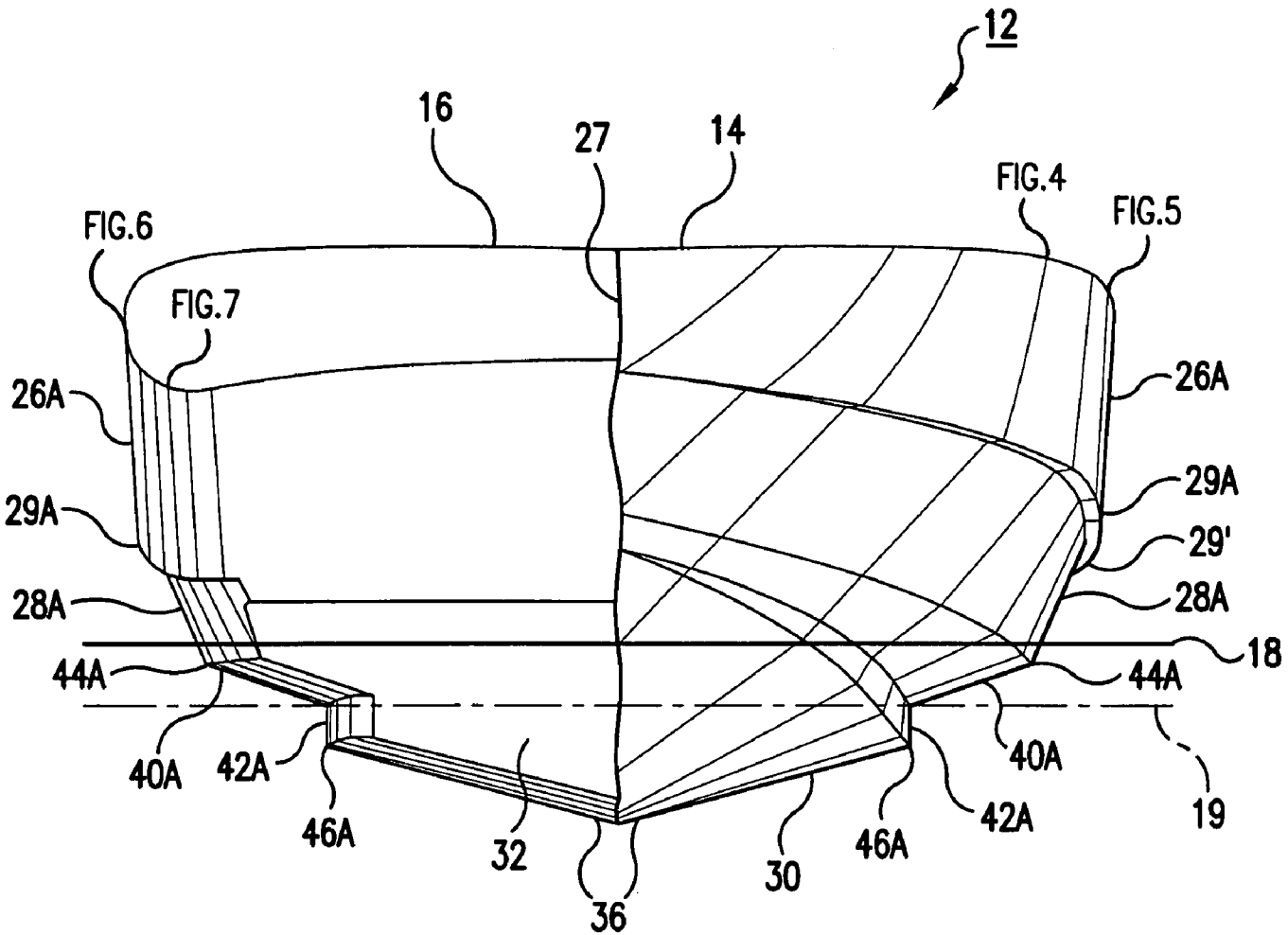
FIG. 3 shows combined end views of the exterior shape of the boat hull shown in FIGS. 1 and 2, divided in half by a vertical plane extending lengthwise down the center of the hull from bow to stern, and showing the forward end of the port side of the hull on the right side of FIG. 3, and the aft end of the port side on the left side of FIG. 3.
Figure 4:
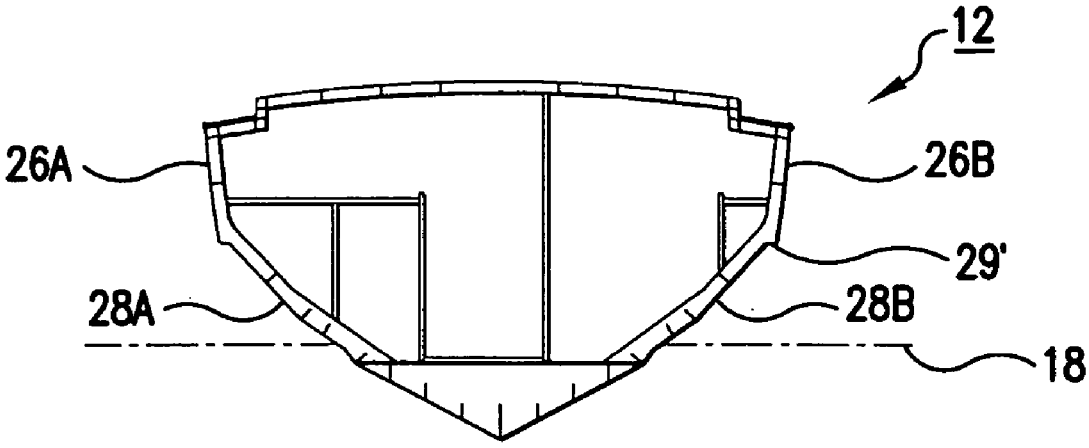
FIGS. 4–7 show cross sections of the boat hull in FIGS. 1–3, taken at stations 2, 4, 6, and 9 in FIG. 1 for the respective FIGS. 4, 5, 6, and 7.
Figure 5:
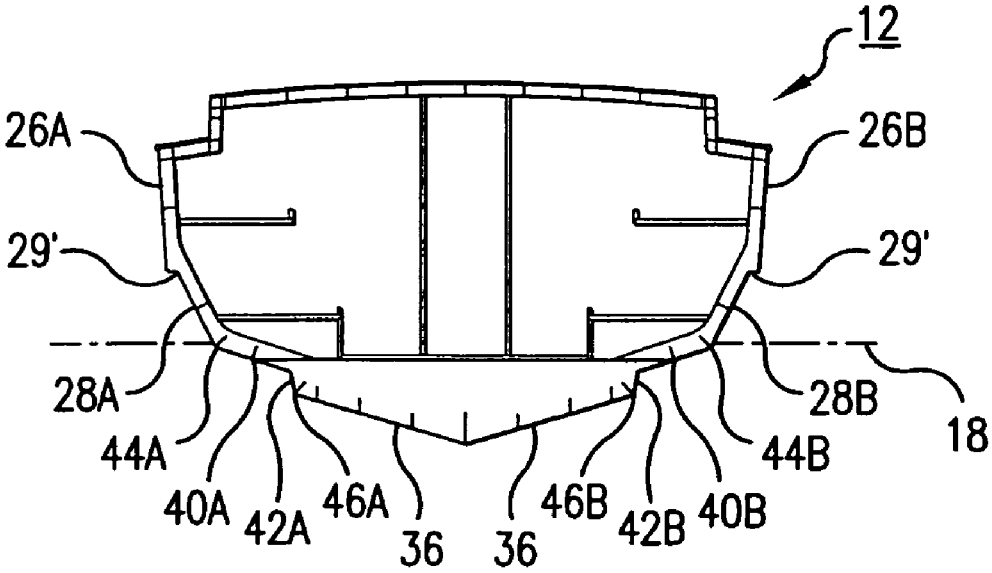
Figure 6:
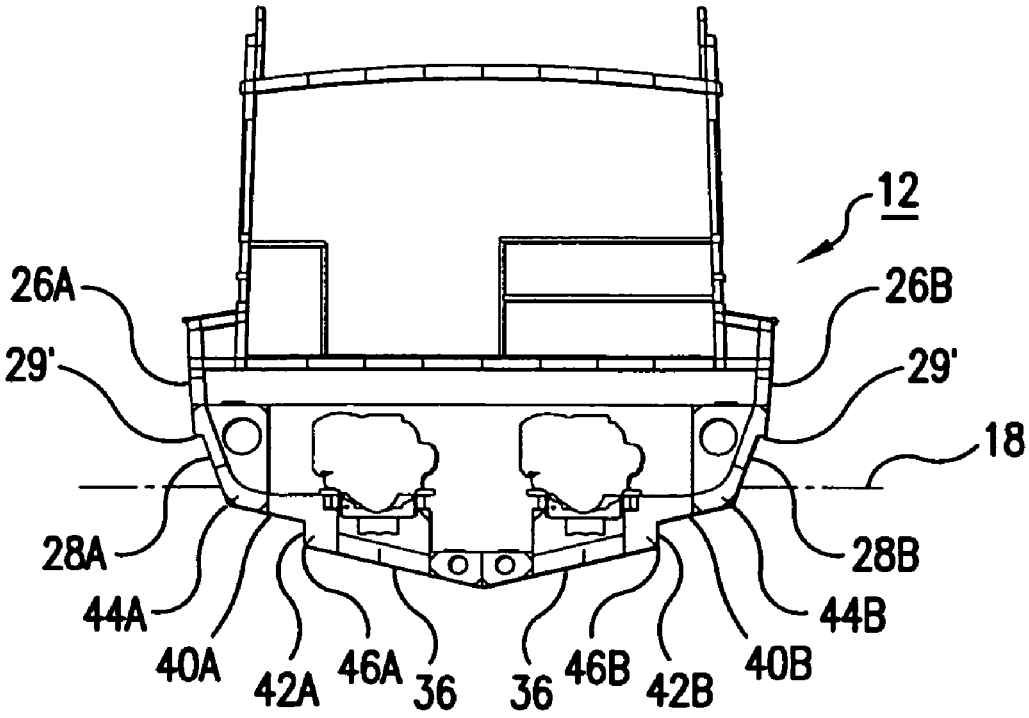
Figure 7:
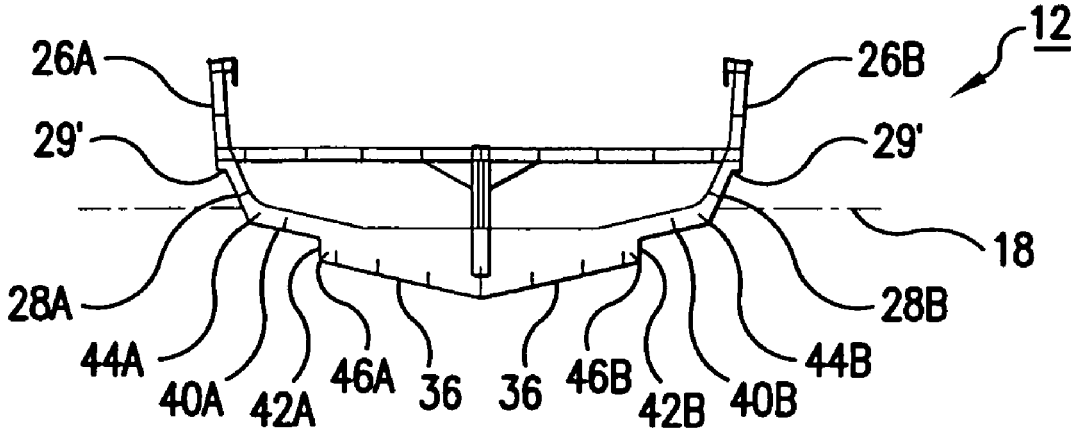

FIG. 3 shows two views of the port side of hull 12, with the view from stern 16 being at left in FIG. 3, and with the view from bow 14 being at right. The two views are divided by central vertical plane 27, the center plane, that bisects hull 12 from bow 14 to stern 16 through the middle of its width. In addition, FIG. 3 shows lines crossing the lower surface of hull 12, each of which shows the intersection of a vertical plane perpendicular to the length of hull 12 with the lower surface. The positions of eleven of these vertical planes are indicated by the section numbers 0 through 10 shown at the bottom of FIG. 1. The cross sections of FIGS. 4, 5, 6, and 7 are taken at the sections numbered 2, 4, 6, and 9, as shown in FIGS. 1 and 3. In addition to the water-contacting cross sections 1 through 10, FIG. 3 therefore also illustrates that cross sections between section number 0 and bow 14 are not water-contacting cross sections because they do not include any part that contacts water and receives buoyancy and lift during normal operation.

Hull 12 has an upper pair of sidewalls 26A and 26B, a lower pair of sidewalls 28A and 28B, and a downwardly facing bottom wall 30, which is closed at the stern by a transversely extending transom 32. Sidewalls 26A and 26B are symmetrical on opposite sides of central vertical plane 27. Sidewalls 28A and 28B and other parts of the lower surface are also symmetrical on port and starboard sides of plane 27.

A pair of reveals 29A and 29B are on port and starboard sides of hull 12 where the lower margins of the upper sidewalls 26A and 26B overlap lower sidewalls 28A and 28B, respectively. Reveals 29A and 29B extend outward from the upper margins of lower sidewalls 28A and 28B. The lower margin of each upper sidewall 26A and 26B has an exposed downwardly facing section 29' (FIG. 4) that extends lengthwise along hull 12. However, sections 29' are too narrow and too high on hull 12 to function as "planing sections", where a planing section is a section that can receive lift while a boat hull is planing.

A boat hull may have more than one "planing stage", meaning a part of the time in which it planes differently than at other times when it is planing. More specifically, if one group of downward-facing sections is the uppermost group contacting the water surface or below the water surface, the hull is "in a planing stage on" or simply "planing on" that group (while any lower groups, such as central planing sections, are, of course, below the water surface). As the hull accelerates so that the group on which it was previously planing is no longer contacting the water surface except due to rolling, waves, or other rough water, the hull "lifts off" the group.

In contrast to sections 29', bottom wall 30 has a central pair of planing sections 36 on which hull 12 can plane in a certain speed range. In the example shown in FIGS. 3–7, bottom wall 30 has a V-shaped surface, and its V-arms are central planing sections 36, but central planing sections could take various other shapes.

In addition, the lower surface of hull 12 includes a pair of supplemental planing sections 40A and 40B on which hull 12 can plane in a lower speed range than the speed range for central planing sections 36. All of the planing sections are substantially linear and downward-facing, with an outward angle above horizontal in each water-contacting cross section. The outward angle of the V-arms is illustratively smaller than the outward angle of supplemental planing sections 40A and 40B with respect to the horizontal. As discussed below, the outward angles of planing sections play a role in planing efficiency and performance.

Step risers 42A and 42B provide a pair of lengthwise-extending outward-facing sections or steps that extend between the outer peripheries of central planing sections 36 and the inner peripheries of supplemental planing sections 40A and 40B. In the illustrated example, the maximum upward length or height of step risers 42A and 42B approximates the vertical separation between water lines 18 (at rest) and 19 (planing).

The boat hull of FIGS. 1–7 therefore illustrates an example of a boat hull or boat hull assembly with a hull body having a lower surface that includes two or more downward-facing sections. The downward-facing sections include a sequence of groups, and the sequence includes a lowermost group and a supplemental group above it.

The boat hull of FIGS. 1–7 also illustrates an example of a boat hull having a lower surface that includes port and starboard sequences of planing sections, and each sequence includes a central section and one or more supplemental sections outward of the central section.

A pair of lengthwise-extending chines 44A and 44B occurs at the intersections of lower sidewalls 28A and 28B with the outer peripheries of supplemental planing sections 40A and 40B, respectively. A pair of similarly extending chines 46A and 46B occurs at the intersections of risers 42A and 42B with the outer peripheries of central planing sections 36.

The forward ends of central planing sections 36 curve upwardly approaching bow 14. This helps sections 36 to rise in but not out of the water when boat 10 accelerates bowward from rest. Boat 10 initially rides up on the bow wave generated by forward motion, which tilts bow 14 up. Boat 10 levels out as the whole lengths of central planing sections 36 rise in the water when forward speed approaches the minimum speed at which hull 12 planes on sections 36.

Meanwhile, supplemental planing sections 40A and 40B, which may be below water while at rest, begin to develop lift until boat 10 begins to plane at the minimum speed of their planing stage. With further acceleration, lift from central planing sections 36 causes sections 40A and 40B to rise higher in the water until hull 12 is in a planing stage on central planing sections 36, which are then carrying the whole weight of the boat at the minimum speed of their planing stage. Even when out of the water most of the time, supplemental planing sections 40A and 40B occasionally touch water when rough water or occasional rolling occurs. Such touching will generate a brief planing effect to stabilize excessive rolling. At even higher speeds, sections 40A and 40B otherwise dry out under normal conditions, however, as discussed below in greater detail. As used herein, a section "dries out" when the amount of spray it receives is less than necessary to maintain its level of wetness.

The boat hull of FIGS. 1–7 therefore illustrates a lower surface that is shaped so that, in a first speed range, it planes on an initial supplemental group of downward-facing sections. In a series of successively higher speed ranges, the lower surface planes on successively lower groups of downward-facing sections, planing on the lowermost group of downward-facing sections in the highest of the speed ranges. As used in this context, a lower surface is "shaped" by any of the various features that result in its shape, such as by a particular curvature and dimensioning of each section as well as by the angles at which sections meet. The shaping of a lower surface, as used in this context, is substantially independent from the process by which the boat hull is manufactured or produced, and relates only to the shape of the lower surface itself.

The boat hull of FIGS. 1–7 also illustrates a lower surface that is shaped so that, as the boat hull accelerates bowward from rest under normal conditions, it begins to plane on an initial pair of its supplemental sections; then it successively lifts off each pair of planing sections on which it is planing and begins to plane on the next inward pair of planing sections until it planes solely on the central sections.

The features that result in the shape of boat hull 12 in FIGS. 1–7 can be described in sequence beginning with central planing sections 36 and proceeding outward. Because of port-starboard symmetry, the sequence is the same on each side. The following particular features of boat hull 12 are believed to be advantageous because they contribute to performance as set forth below.

Central planing sections 36 are designed to satisfy constraints that ensure least resistance in a top speed range. For example, their widths are chosen to produce near-optimal performance. An ideal beam width can be calculated based on characteristics of displacement, speed, length, and so forth. For example, Teale, John, "High Speed Power Boats," Westlawn Institute of Marine Technology, No. 117, 1988, pp. 12–15, incorporated herein by reference, provides a calculation based on total displacement, distance from center of pressure to transom along the water line, and target top speed; various other calculations could be used to obtain similar values for the beam width at which a hull has approximately optimum performance. As used herein, an "ideal beam width" is a calculated width that produces approximately optimum performance, regardless of the specific calculation used. Specifically, the ideal beam widths calculated below are widths between chines and, unless otherwise noted, are the maximum width between chines along the length of a boat hull.

For a boat of length 50.615 ft. with a projected chine length of 44.76 ft., a displacement of 42,500 lbs., a water line length of 18.34 ft. from the transom to center of gravity, and a target top speed of 40 knots, an ideal beam width of 10.6 ft. is obtained with Teale's calculation. The resulting length/beam ratio is approximately 4.22, close to that of Model 4667-1 of DTMB Series No. 62. The models of Series 62 are recognized as low resistance designs and are described in Clement, Eugene P., and Blount, Donald L., "Resistance Tests of a Systematic Series of Planing Hull Forms," The Society of Naval Architects and Marine Engineers, No. 10, November 1963, pp. 1–71 (Clement and Blount), incorporated herein by reference in its entirety. Although hull 12 does not follow the entire hull form for Model 4667-1, the shape is the same as Model 4667-1 up to the chine line. As noted above, chines 46A and 46B separate the outer peripheries of central planing sections 36 from step risers 42A and 42B. The chine line can follow the plan view for Model 4667-1, resulting in curvature as shown in FIG. 3, above.

The orientation and height of step risers 42A and 42B are not determined by the specifications for Model 4667-1 since they are features not present in Series 62. As can be seen in FIG. 3, the orientation is approximately vertical and the height h is substantially constant from stern 16 to approximately amidship, after which it decreases uniformly to zero at bow 14. In cross sections that do not contact water, however, risers 42A and 42B could depart from vertical and from uniformly decreasing height without affecting hull performance.

The constant height between stern 16 and amidship can, for example, have the value H, where H is not less than approximately 0.00595 $L_p$ and where $L_p$ is chine length from stern to bow measured in the same units as H. For a boat with chine length 44.76 ft., $L_p$=537.12 in., and H≧3.196 in., it has been found that a value of H obtained in this manner promotes drying out of the next outward chine, in part because the resulting level of sections 40A and 40B is above the wake from sections 36 at the low end of their planing speed range. In addition, this height accommodates spray strips, as discussed in greater detail below.

The upper peripheries of step risers 42A and 42B are also the inner peripheries of supplemental planing sections 40A and 40B. As with central planing sections 36, supplemental planing sections 40A and 40B can be shaped at least up to their chine lines in accordance with another of the Series 62 models described by Clement and Blount, incorporated by reference above.

As discussed below in relation to FIG. 11, a transition speed can be chosen approximately equal to the speed at which the lift from sections 36 separately is the same as the lift from another of the Series 62 models having a chine width of sections 40A and 40B that is consistent with the desired width of hull 12. This approach can lead, for example to the selection of Model 4666. As further discussed below, a transition speed obtained in this manner is approximately the same as the top speed that would result in the ideal beam width. In other words, taking the length and displacement characteristics of hull 12, taking a chine beam width of 13 ft., and applying the characteristics of Model 4666, one obtains a transition speed for which the ideal beam width is approximately 13 ft.

Various other hull shapes could be used instead of Model 4666, but a number of constraints should be applied in order to approach optimum performance. It has been found, for example, that spray while planing solely on central planing sections can be reduced to insignificant levels by not decreasing deadrise of planing sections in the sequence. Therefore, in any water-contacting cross section, the deadrise of sections 40A is no less than that of central planing sections 36. In addition, spray strips as described below in relation to FIG. 12 can be used to prevent water from creeping up risers 42A and 42B, which would otherwise prevent sections 40A and 40B from drying out.

Another important constraint is trim angle. As used here, the term "trim angle" refers to the angular rotation of the boat hull from its position at rest about a transverse horizontal axis of rotation. Trim angle is also sometimes referred to as "angle of attack".

As described by Savitsky, Daniel, "Hydrodynamic Design of Planing Hulls," Society of Naval Architects & Marine Engineers, October 1964, pp. 71–95, a trim angle of approximately 40 to 50 results in minimum drag-lift ratio, and trim angle is also a factor in preventing "porpoising", i.e. alternately diving and flying. Accordingly, hull 12 is designed to run at trim angles between 30° and 6° both when it is planing on central planing sections 36 and when it is planing on supplemental planing sections 40A and 40B at intermediate speeds approaching the transition speed. Minor modifications may be made in the shape of the lower surface of hull 12, but it has been found that it is possible to maintain trim angle between 3.5° and 5.5° within the normal bowward speed range, and possibly even between 4.0° and 5.0° in some cases.

As described above, the planing speed range for central planing sections 36 provides top speed operation for hull 12. Furthermore, the planing speed range for supplemental planing sections 40A and 40B can be chosen to be suitable for cruising, so that the operator can, in effect, select a group of planing sections whose planing speed range is appropriate to the task at hand, whether cruising or traveling at top speed.

Improved boat hull performance allows greater latitude in designing other features of a boat. For example, a high performance boat can be operated with the same engines as a lower performance boat to obtain a higher top speed. Alternatively, smaller engines can be used, allowing reduction in boat weight and obtaining higher fuel economy at the same top speed. In addition, an intermediate design choice can be made for a particular situation, to obtain a desired combination of top speed, engine size, boat weight, and fuel economy.

The shaft horsepower (SHP) necessary to obtain a top speed of 40 knots with hull 12 in FIGS. 1–7 can be estimated based on the losses that must be overcome. Taking into account the reduced friction of water against the wetted surface of hull 12 and assuming minimized wave making resulting in least drag due to the shape of hull 12, engines providing 1023 SHP would be able to propel boat 10 at a speed of 40 knots. This is an improvement of 18% over the Ocean 48 boat which has a maximum beam width of 15.17 ft., a deadrise of 19°, and requires 1250 SHP. An even greater improvement would be measured relative to other sport fishing boats similar to the Ocean 48 but that require engine capacities closer to 2800 SHP because they have some combination of less optimal hulls, higher loss appendages, and less optimal propellers.

Another way to compare performance of different boats is to use the performance coefficient $C_k$ attributed to G. Crouch and calculated as follows:

$$C_k = V_k\sqrt{\frac{\Delta}{SHP}}$$

where $V_k$ is velocity in knots (nautical miles per hour); Δ is displacement in pounds; and SHP is power measured at the output shaft of the engine or motor. A higher value of $C_k$ indicates a more efficient boat hull and propulsor at equal displacement and speed, with efficiency resulting from less drag and lower shaft horsepower. The coefficient $C_k$ is sensitive to hull length and can be collapsed to a nearly linear relationship of constant Froude numbers, $F_{nv}$, by plotting the values of $C_k$ against the cube root of chine length $L_p$ (where chine length is the distance between the perpendiculars to the water line at rest at the transom and the point where the chine intersects with the stem or bow). Once a value for $C_k$ is been established for a given hull, one can estimate the SHP needed to drive the hull to other speeds or with other values of displacement at a given speed.

The boat hull of FIGS. 1–7, with chine length of 44.76 ft., displacement of 42,500 lbs., and top speed of 40 knots, has $C_k$ of 249.4, indicating it is significantly more efficient than other boats of similar length. For example, the Ocean 48, with chine length of 44.76 ft., has a $C_k$ of 192.4; the Bertram 510, with chine length of about 45.5 ft., has a $C_k$ of 185; and the Henriques 50, with chine length of about 50 ft., has a $C_k$ of 158.

The boat hull of FIGS. 1–7 illustrates a boat hull or boat hull assembly in which, when planing in the speed range for a supplemental group of sections, the boat hull's or hull assembly's trim angle is between about 3.0° and about 6.0°.

The boat hull of FIGS. 1–7 also illustrates a boat hull in which each supplemental group of downward-facing sections includes a port section and a starboard section, each of which is outward of its next lower downward-facing section. The boat hull is structured so that, when planing on a lower group of downward-facing sections, the next higher group dries out.

The boat hull of FIGS. 1–7 illustrates several techniques for drying out higher sections, including deadrise angles that do not decrease, transition sections that have spray strips, transition sections that have sufficient height to permit drying out, and so forth. More specifically, in the illustrated boat hull, each pair of supplemental sections from the initial pair inward has an outward angle that is above horizontal and is not smaller than the next inward pair's outward angle.

The boat hull of FIGS. 1–7 also illustrates a boat hull designed for a set of displacement characteristics. The lowermost group of downward-facing sections has a maximum width between its outer peripheries, as well as a target maximum speed. The maximum width is approximately equal to an ideal beam width for the set of displacement characteristics and for the target maximum speed. The displacement characteristics could include, for example, total displacement and a length from the lowermost group's aft end to the boat hull's center of gravity.

A boat hull as in FIGS. 1–7, with only one pair of supplemental planing sections, can meet constraints applicable to a relatively long, narrow hull. The same design approach can be used to produce a wide variety of boat hulls. For example, another boat hull has been designed with a chine length of 37.724 ft., a displacement of 24,904 lbs., a target top speed of 40 knots, central planing sections shaped like Series 62 Model 4667-1 with chine beam width of 10.792 ft., and supplemental planing sections shaped like Series 62 Model 4666 with chine beam width of 12 ft. In this case, however, the difference in the maximum chine beam width between the two groups of planing sections is relatively small, so that the supplemental planing sections extend only a small distance beyond the chines of the central planing sections. Despite the small difference in beam width, SHP required to reach the same top speed is approximately 10% less than for an unmodified Model 4666 hull of the same length, indicating a significant performance improvement.

A one-twelfth model of this hull has been produced and preliminary tests have been performed by towing the model: The model successfully made the transition from supplemental planing sections to central planing sections, and its visual appearance indicated that the supplemental planing sections were drying out during planing on the central planing sections and the target low resistance value was confirmed.

For many hulls, however, the ideal beam width between the chines or other outer peripheries of the central planing sections can be extremely narrow if a similar or greater top speed is desired. For a 46 ft. racing boat such as a Cigarette Hp/Rough Rider, for example, an ideal beam width would be less than 3 ft., substantially narrower than the already narrow design with 8 ft. maximum beam width. A 3 ft. beam would be unstable at rest and would restrict the interior space needed for crew and engines, despite its advantages in efficiency and performance. Similarly, for a 16 ft. Runabout sport boat used for water sports, weighing about 1200 lbs. and having a target top speed of 35 knots, the ideal beam width is less than 2 ft. In situations like these, a different design approach is necessary to obtain similarly high efficiency and improved performance.

To address this need, boat 100 in FIG. 8 (shown with horizontal planes 102 and transverse planes 104) has a monohull 112 with bow 114 and stern 116, and with multiple planing stages as described in greater detail below. Similarly to boat 10 in FIG. 1, boat 100 is designed to float at water line 118 when at rest and to plane at water line 119 at its maximum speed (water lines 118 and 119 are at the intersections of the lower surface of monohull 112 with two of horizontal planes 102 in FIG. 8).

Figure 8:
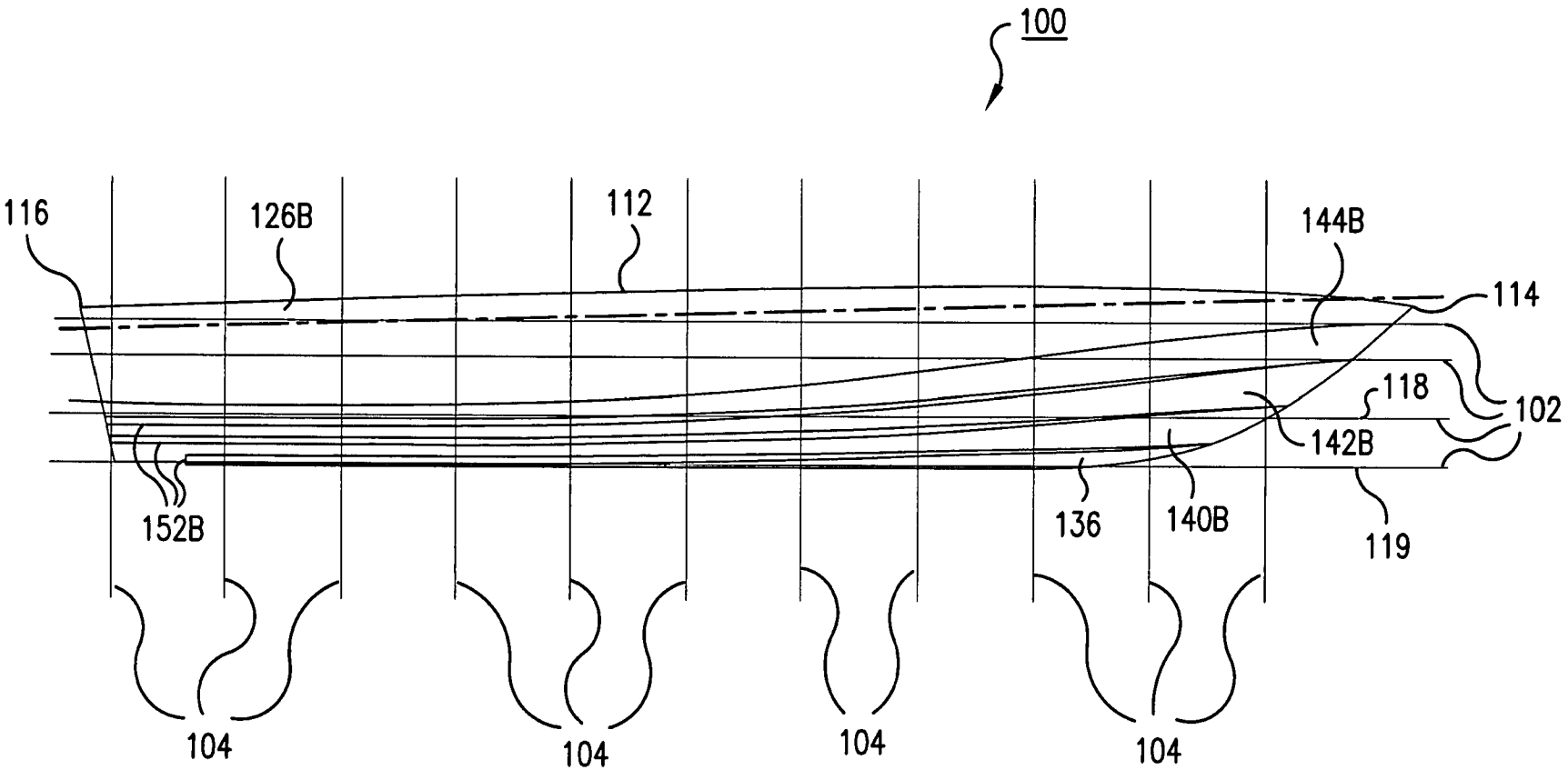
FIG. 8 is a side profile view of another monohull with multiple groups of planing sections.
Figure 9:
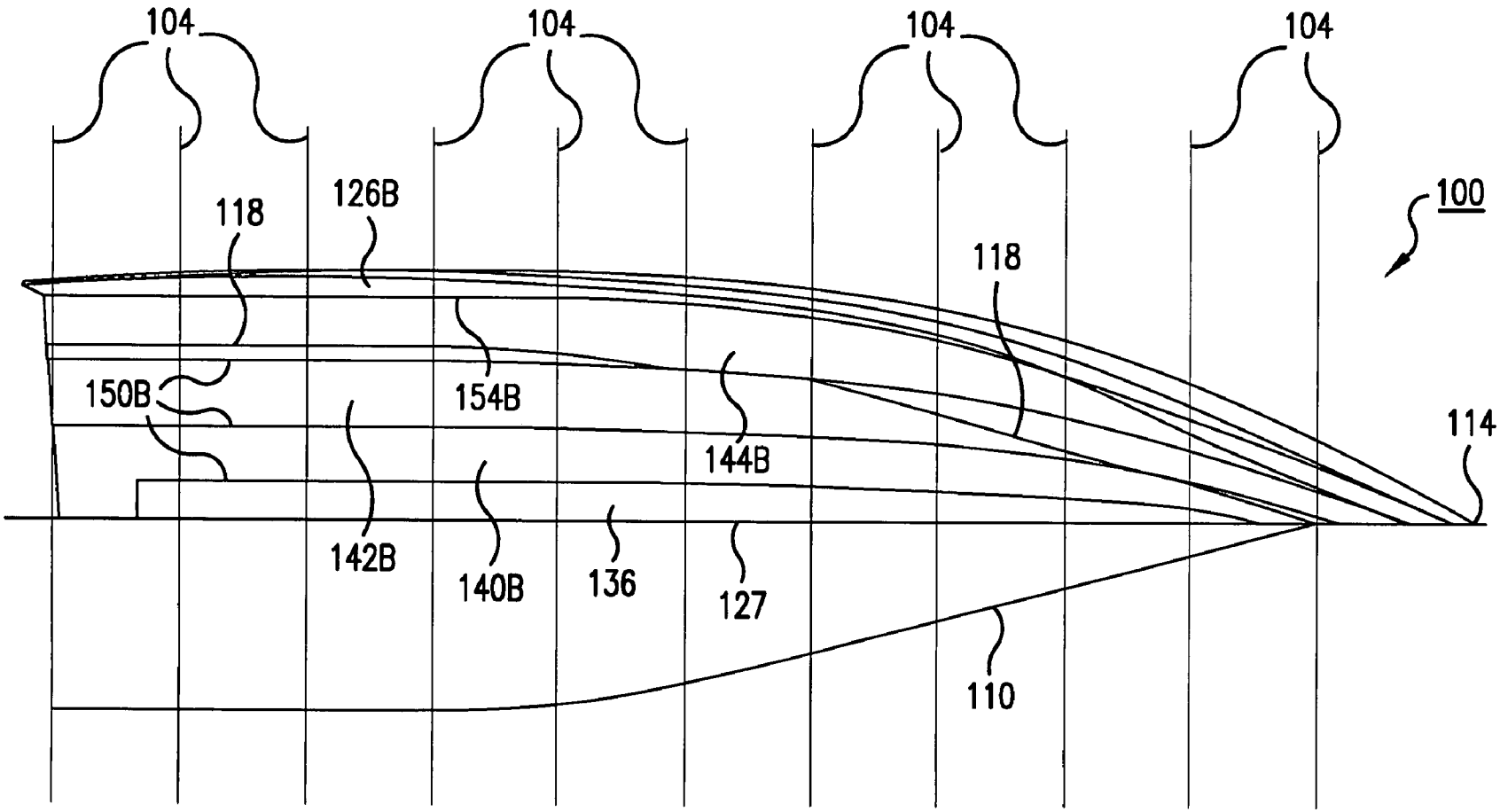
FIG. 9 shows, in its upper half, a bottom plan view looking upward from beneath the starboard half of the monohull shown in FIG. 8, and, in its lower half, an inverted graph of hull area below water line as a function of lengthwise position.

The upper side of FIG. 9 shows the starboard half of monohull 112 from below, with transverse planes 104 as in FIG. 8 and with water line 118 also shown. As in FIG. 2, boat 100 can have a single engine or more (not shown) mounted in monohull 112 to drive one or more shafts and propellers (not shown). In addition, the lower side of FIG. 9 shows curve 110, an inverted graph that illustrates the cross-sectional area below water line 118 at each position along the length of monohull 112. When integrated, this graph equals the underbody volume displaced to support the boat at rest.

Figure 10:
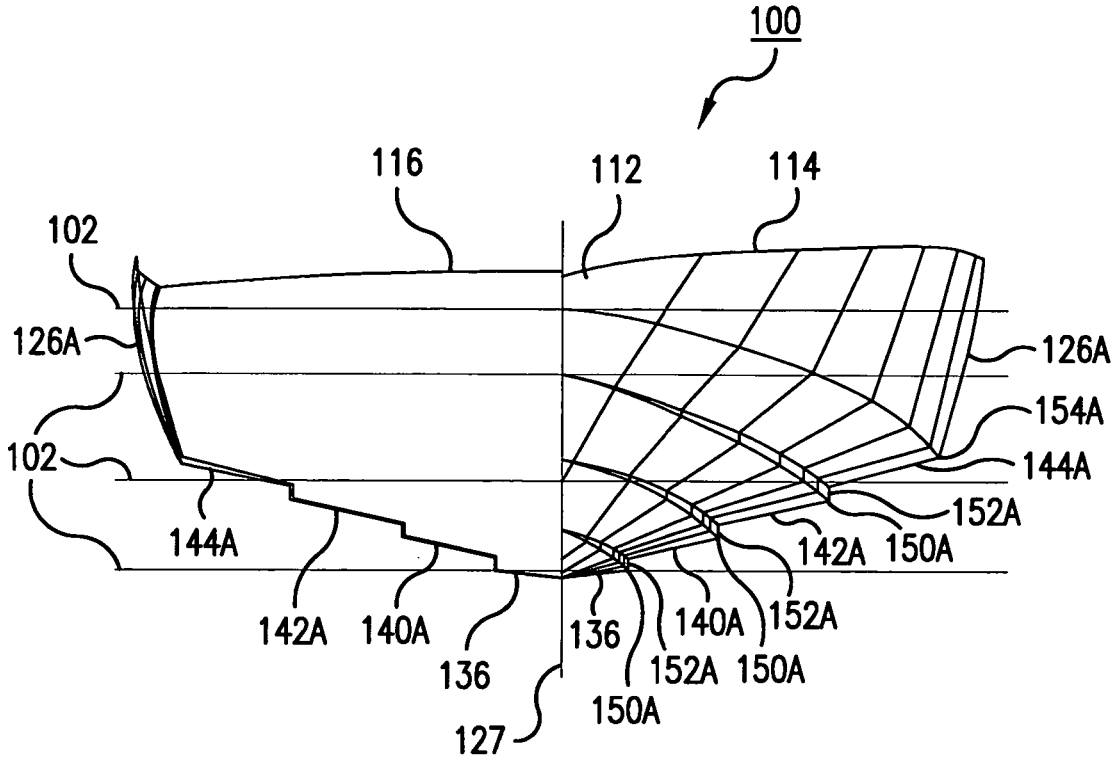
FIG. 10 shows combined end views of the exterior shape of the boat hull shown in FIGS. 8–9, divided in half as in FIG. 3, and showing the forward end of the port side of the hull on the right side of FIG. 10, and the aft end of the port side on the left side of FIG. 10.

FIG. 10 shows two views of the port side of monohull 112, with the view from stern 116 at left and with the view from bow 114 at right. The two views are divided by central vertical plane 127, a center plane that bisects monohull 112 from bow 114 to stern 116. As in FIG. 3, FIG. 10 shows lines, each for the intersection of one of planes 104 with the lower surface of monohull 112.

As can be seen from FIGS. 8–10, monohull 112 has an upper pair of sidewalls 126A and 126B, which are symmetrical on opposite sides of central vertical plane 127, as are other parts of the lower surface in the same manner as for hull 12 in FIGS. 1–7. The remainder of monohull 112 includes four distinct pairs of planing sections, as described in greater detail below.

Central planing sections 136 are the V-arms of a V-shaped bottom portion of monohull 112. The next outward pair of downward-facing sections is supplemental planing sections 140A and 140B followed in sequence by supplemental planing sections 142A and 142B and finally supplemental planing sections 144A and 144B. The outward angles of central planing sections 136 are no greater than those of supplemental planing sections 140A and 140B, and so forth through the sequence, so that the outward angles do not decrease in any water contacting cross section.

Between each adjacent pair of planing sections, a transition section includes chine 150A or 150B and vertical risers 152A and 152B. Risers 152A and 152B have maximum upward length or height approximately equal to the vertical separation between the planing levels of the adjacent downward-facing sections. In addition, chines 154A and 154B occur where the outer periphery of sections 144A and 144B meet sidewalls 126A and 126B, respectively.

The boat hull of FIGS. 8–10 therefore illustrates an example of a boat hull or boat hull assembly with a hull body having a lower surface that includes two or more downward-facing sections. The downward-facing sections include a sequence of groups, and the sequence includes a lowermost group and three supplemental groups above it.

The boat hull of FIGS. 8–10 also illustrates an example of a boat hull having a lower surface that includes port and starboard sequences of planing sections, and each sequence includes a central section and one or more supplemental sections outward of the central section.

As described above in relation to the hull of FIGS. 1–7, the forward ends of central planing sections 136 curve upwardly approaching bow 114, which helps sections 136 to rise in but not out of the water when boat 100 accelerates bowward from rest. In addition, each opposing pair of transition sections 152A and 152B intersects at bow 114.

A shape for monohull 112 could be obtained in various ways. The shape illustrated in FIGS. 8–10 was obtained as follows:

Certain overall characteristics of monohull 112 were determined, including, e.g., length of 24.42 ft., displacement of 2804 lbs. (including weight of monohull 112 and also estimated fuel and cargo loads), target top speed of 62.5 knots, and maximum beam width at the deck of 8.0 ft. With this information, central planing sections 136 were designed, with chine lines shaped in accordance with Series 62, chine length of 18.33 ft., deadrise at aft end of 5° (as opposed to 12.5° deadrise at transom for Series 62 hulls; the decrease avoids excessive depth and allows sufficient riser height for outward sections to dry out), and chine beam width of 1.25 ft., which is approximately equal to the ideal beam width according to the calculation described by Teale, incorporated by reference above. As can be seen in FIGS. 8 and 9, the chine length of central planing sections 136 ends about 1.36 ft. forward of the transom of monohull 112, advantageously reducing the length from the aft end of central planing sections 136 to the center of gravity. This affects the ideal beam width calculation and also produce beneficial effects when planing solely on central planing sections 136.

The shapes of supplemental planing sections 144A and 144B, sidewalls 126A and 126B, and chines 154A and 154B were also designed, with a maximum chine beam width of 7.5 ft. Based on the length/beam ratio of approximately 3, the shape of the Series 62 Model 4666 was chosen, because its length/beam ratio is 3.06. (Note that if a design's central planing sections have the same Series 62 model number as the design's outermost planing sections, no supplemental planing sections are necessary—a standard Series 62 model would meet the design constraints.)

At this point, sufficient information was available to plot vertical center of gravity level against speed for each group of downward-facing sections that could be included in the lower surface of monohull 112. In addition to the curves for Model 4666 and for central planing sections 136, curves could also be plotted for Models 4667-1, 4668, and 4669. A graph with curves of this type showed three transition speeds—9.46 knots, 22.7 knots, and 38.5 knots—at which lift from successive groups of downward-facing sections would be approximately equal, allowing monohull 112 to make a transition from one group of downward-facing sections to the next. The counterpart sequence of shapes outward from central planing sections 136 is Model 4669, Model 4667-1, and then Model 4666.

Based on this, supplemental planing sections 142A and 142 B were designed to have the shape of Model 4667-1 and maximum chine beam width of 5.12 ft., and supplemental planing sections 140A and 140B were designed to have the shape of Model 4669 and maximum chine beam width of 3.0 ft. In addition, heights were obtained for risers 152A and 152B sufficiently large to allow higher sections of the lower surface to dry out when planing on a lower downward-facing section, in the same manner described above in relation to FIGS. 1–7. In each case, a constant height between the aft end of a chine and amidship can, for example, have the value H, where H is not less than approximately 0.00595 $L_p$ and where $L_p$ is chine length measured in the same units as H. As described above, a value of H obtained in this manner promotes drying out of the next outward chine.

Figure 11:
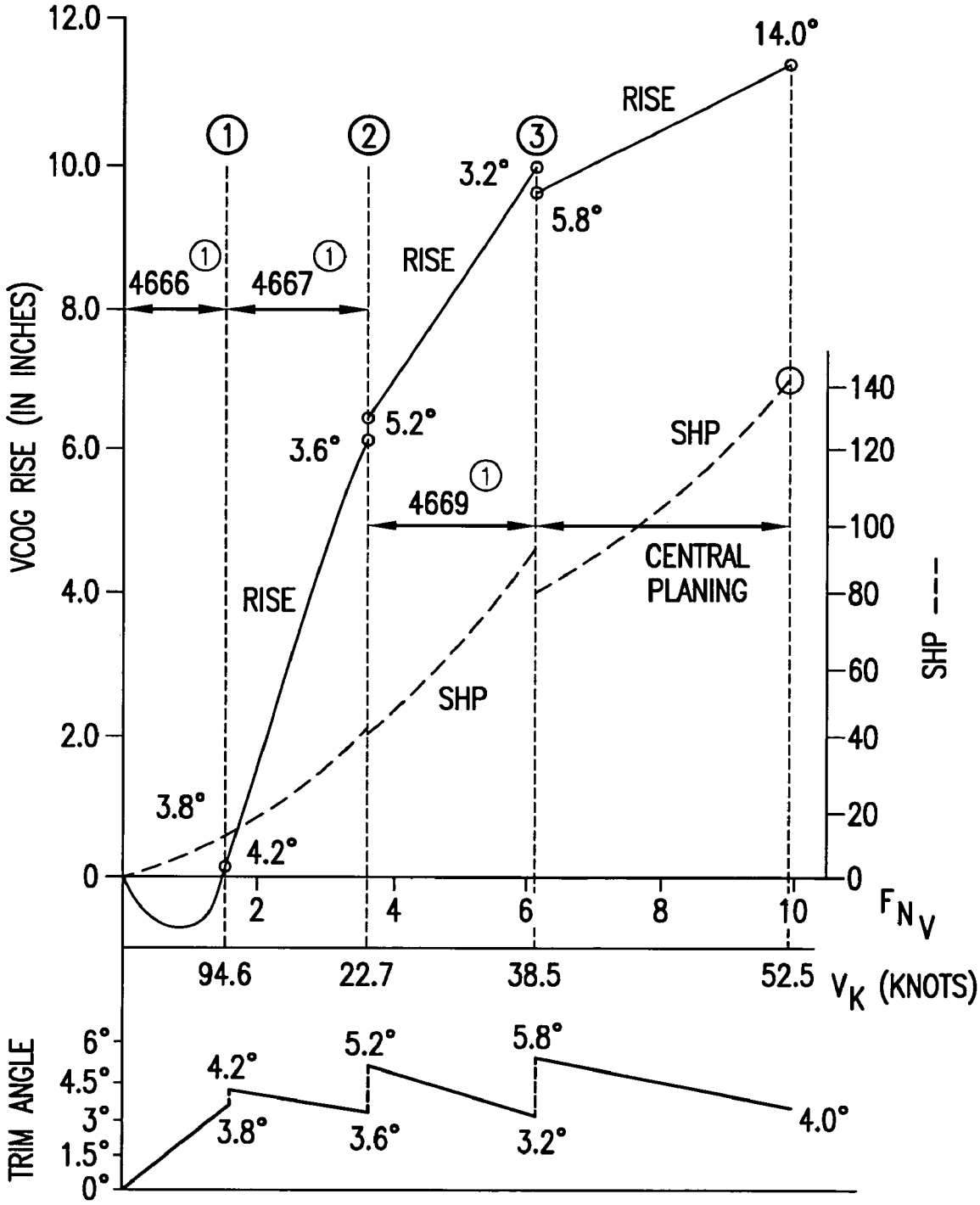
FIG. 11 is a graph showing VCOG level and trim angle as functions of speed for the boat hull of FIGS. 8–10.

FIG. 11 illustrates calculated vertical center of gravity (VCOG) and trim angle of monohull 112 as a function of speed (and Froude number $F_N$, which is proportional to the ratio of speed to the square root of the product of gravitational constant g with the cubic root of volume of a boat's displacement at rest). FIG. 11 also provides information about horsepower requirements.

The upper portion of FIG. 11 shows four solid lines, each of which connects plotted values of VCOG rise for the ends of the speed range of one of the groups of downward-facing sections of monohull 112. The first solid line covers speeds between rest and 9.46 knots, the speed range in which monohull 112 is expected to plane on sections 144A and 144B; this line curves below the horizontal axis to illustrate that, as described above, the VCOG of a planing boat hull initially drops and then rises until planing begins, illustratively just before 9.46 knots. The second solid line covers speeds between 9.46 and 22.7 knots, the expected speed range for planing on sections 142A and 142B; this line extends from just above where planing begins to slightly more than 6.0 in. of rise. The third solid line covers between 22.7 and 38.5 knots, the expected speed range for planing on sections 140A and 140B; this line extends from about 6.5 in. of rise to just over 10.0 in. of rise. The fourth solid line covers speeds between 38.5 and 62.5 knots, the expected speed range for planing on sections 136; this line extends from just under 10.0 in. of rise to about 11.5 in. of rise, the rise at target top speed. Although the second, third, and fourth solid lines are illustrated by approximately straight lines, it will be understood that the actual curve followed by monohull 112 depart somewhat from straight.

The lower portion of FIG. 11 also shows four solid lines that correspond to the four solid lines in the upper part, each of which is again an approximation connecting plotted trim angle values for one of the groups of downward-facing sections across its speed range. The first solid line, for sections 144A and 144B, rises from zero at rest to 3.8° at 9.46 knots, but does not show the rise in trim angle that would occur when monohull 112 initially drops. The second solid line begins at 4.2° at 9.46 knots and drops to 3.6° at 22.7 knots. The third solid line begins at 5.2° at 22.7 knots and drops to 3.8° at 38.5 knots. The fourth solid line begins at 3.2° at 38.5 knots and drops to 4.0° at 62.5 knots. In other words, once planing has begun, trim angle remains between 3.0° and 6.0° until target top speed is reached.

As an operator accelerates a boat based on monohull 112 from rest to target top speed, the boat would go through a series of planing stages. The first planing stage is very short and ends around 9.46 knots when the boat would stop planing on sections 144A and 144B and would make a transition to a second stage. In the second stage, the boat would plane on sections 142A and 142B and sections 144A and 144B would dry out until another transition at around 22.7 knots would begin a third stage. In the third stage, the boat would plane on sections 140A and 140B and sections 142A and 142B would dry out until a final transition at around 38.5 knots would begin a fourth stage. The fourth stage would continue until target top speed of 62.5 knots. As will be understood, the transitions may not occur precisely at the transition speeds shown in FIG. 11, but would occur when lift from the next inward group of downward-facing sections is sufficient to raise the next outward group to where they can dry out.

The monohull of FIGS. 8–10 therefore illustrates a lower surface that is shaped so that, in a first speed range, it planes on an initial supplemental group of downward-facing sections. In a series of successively higher speed ranges, the lower surface planes on successively lower groups of downward-facing sections, planing on the lowermost group of downward-facing sections in the highest of the speed ranges.

More specifically, the monohull of FIGS. 8–10 illustrates a boat hull or boat hull assembly in which, when planing in the speed range for a supplemental group of sections, the boat hull's or hull assembly's trim angle is between about 3.0° and about 6.0°. Also, it illustrates a boat hull in which each supplemental group of downward-facing sections includes a port section and a starboard section, each of which is outward of its next lower downward-facing section. The boat hull is structured so that, when planing on a lower group of downward-facing sections, the next higher group dries out, using techniques similar to those described above for the boat hull of FIGS. 1–7.

The monohull of FIGS. 8–10 also illustrates a lower surface that is shaped so that, as the boat hull accelerates bowward from rest under normal conditions, it begins to plane on an initial pair of its supplemental sections; then it successively lifts off each pair of planing sections on which it is planing and begins to plane on the next inward pair of planing sections until it planes solely on the central sections. The monohull is designed for a set of displacement characteristics. The lowermost group of downward-facing sections has a maximum width between its outer peripheries, as well as a target maximum speed. The maximum width is approximately equal to an ideal beam width for the set of displacement characteristics and for the target maximum speed. The displacement characteristics could include the examples mentioned above for FIGS. 1–7, such as total displacement and length from the lowermost group's aft end to the boat hull's center of gravity.

The particular advantageous features of hull 12 described above are also believed to contribute to performance of monohull 112. In addition, the additional groups of downward-facing sections, one including sections 140A and 140B and the other including sections 142A and 142B, provide additional intermediate cruising speed ranges with better performance than would be possible with a standard Model 4666 hull.

In addition, as shown by the dashed SHP curves in the upper part of FIG. 11, the maximum horsepower requirement is only 141.2 SHP, much less than would be required for a standard Model 4666 hull, which incidentally would have a top stable speed around 31 knots and a trim angle of 1.12° at that speed according to model test results. This is also an improvement over published data for other well-known hulls of similar length: The Maverick 21 hull designed by Michael Peters, for example, has a maximum beam width of 8.0 ft., a deadrise of 18°, and requires 225 SHP at a displacement of 2350 lbs. at 62.5 knots or 266 SHP at a displacement of 2780 lbs. at 62.5 knots; the Allison XB-21 Presport "Sub" has a top speed of 71.4 knots and requires 200 SHP at a displacement of 2600 lbs.; the Moesly "Sea Craft" SC 21 has a top speed of 37.4 knots and requires 240 SHP at a displacement of 4411 lbs.; and the Moesly "Sea Craft" SC 25 has a top speed of 47.8 knots and requires 400 SHP at a displacement of 5320 lbs.

Following the approach described above, it is possible to compare performance coefficient $C_k$ between similar boats. The boat hull of FIGS. 8–10, with chine length of 21.0 ft., displacement of 2804 lbs., and top speed of 62.5 knots, has $C_k$ of 277.3, indicating it is significantly more efficient than other boats of similar length. For example, the Maverick 21, with chine length of 19.5 ft., has a $C_k$ of 201.9; the Allison XB-21, with chine length of 18 ft., has a $C_k$ of 257.4; the Moesly SC 25, with chine length of 24 ft., has a $C_k$ of 174.4; and the Moesly SC 21, with chine length of 19 ft., has a $C_k$ of 160.0.

Figure 12:
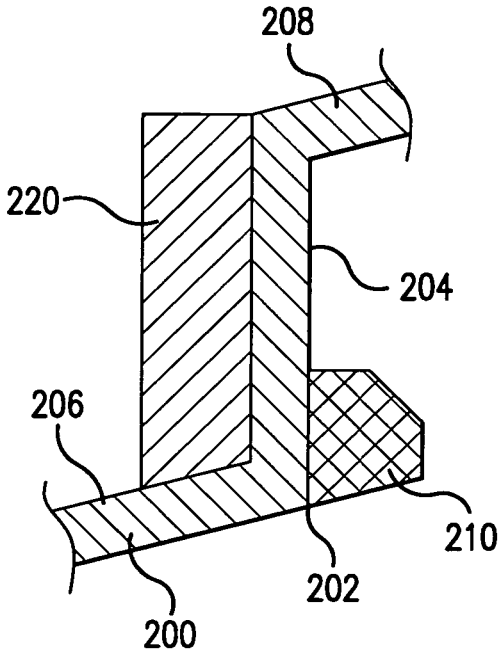
FIG. 12 is a cross section of a chine and riser that could be used in the boat hulls of FIGS. 1–7 and 8–10, with an attached spray strip and a longitudinal frame member supporting the riser's vertical face.

FIG. 12 shows additional features that can be used with any of the implementations described above. These features are shown in cross section, and could be provided to any vertical riser above a chine.

Hull body portion 200 in FIG. 12 includes a transition section with chine 202 and outward-facing vertical section 204. The transition section extends between the outer periphery of downward-facing planing section 206 and the inward periphery of downward-facing planing section 208.

Spray strip 210 on vertical section 204 provides a lower lip that extends the lower line of planing section 206 beyond chine 202, which has the effect of breaking a spray sheet that creeps up planing section 206, preventing the spray sheet from climbing up vertical section 204 and reattaching to planing section 208. Therefore, the spray sheet cannot wet sections 204 and 208, permitting them to dry out, reducing friction losses. Spray strip 210 could be fabricated as part of the hull body, or could be a separate component that is attached after the hull body is manufactured, such as by gluing or other attachment to vertical section 204 after the hull body is injection molded or formed in another suitable manner.

FIG. 12 also shows longitudinal member 220, a structural component of the hull body that supports the transition section and, more specifically, supports vertical section 204. Member 220 could, for example, be a wood or foam member over which the hull body is formed of fiberglass to improve drying of outward sections when planing on inward planing sections. A foam member would include fiberglass or carbon fibers for additional strength. A longitudinal member positioned as shown can be advantageous because it ties a vertical section into the hull body's structure without adding to the boat hull's weight.

Some of the above exemplary implementations suggest boat hulls made with specific shapes and sizes of specific materials with specific structures and uses, but the invention could be implemented with a wide variety of shapes, sizes, materials, and structures for a variety of uses, including but not limited to military, pleasure, and racing uses. For example, a model boat could be made in accordance with the techniques described above. Furthermore, boat hulls in accordance with the invention could be manufactured using any suitable technology; exemplary construction techniques include solid wood, plywood sections on wood frame, fiberglass on wood core, fiberglass on foam core, molded fiberglass without a core, injection-molded plastic (with any spray strips glued on after molding), steel or aluminum plates, bent or formed aluminum, and so forth.

The above exemplary implementations involve some planing sections that are shaped in accordance with models from Series 62, but the invention could be implemented with planing sections having various other shapes and dimensions. Furthermore, the above exemplary implementations involve two or four groups of planing sections, but any appropriate number of groups could be used.

The above exemplary implementations generally involve V-shaped central planing sections, planing sections that are linear in each water-contacting cross section, transition sections that include chines and outward-facing vertical sections, and other related features. Such features could, however, be modified in various ways within the scope of the invention. For example, spray rails could be added to one or more of the planing sections in accordance with conventional techniques, or, as an alternative to spray strips, chine flats could be added to a transition section between planing sections. Also, a boat hull could include transverse steps in addition to the longitudinal steps.

The above exemplary implementations involve monohulls with port-starboard symmetrical pairs of planing sections, but various other hull assemblies could be used, including asymmetrical groups of planing sections on a monohull as well as multi-hull assemblies such as catamarans, trimarans, and so forth, with any suitable combination of symmetrical and asymmetrical hull bodies. As used herein, the term "boat hull assembly" includes not only monohulls and also other connected combinations of boat hulls, as in a catamaran, a trimaran, and so forth. In some implementations of boat hull assemblies, for example, some groups of downward-facing planing sections could include sections on two or more asymmetrical hull bodies, while other groups could include symmetrical planing sections on a central hull body.

While the invention has been described in conjunction with specific exemplary implementations, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A boat hull comprising:

a hull body having a lower surface that includes a sequence of groups, each including one or more downward-facing sections; the sequence including a lowermost group and one or more supplemental groups above the lowermost group;

the lower surface being shaped so that, in a first speed range, an initial one of the supplemental groups is the uppermost group contacting or below a water surface, and, in a series of successively higher speed ranges, successively lower groups are each the uppermost group contacting or below the water surface, the lowermost group being the uppermost group contacting or below the water surface in the highest of the series of speed ranges;

the lower surface further including:

for each supplemental group in a set of one or more of the supplemental groups, a respective outward facing transition section between each downward-facing section in the group and an adjacent downward-facing section in the group's next lower group, a respective outward facing transition section; and for at least one supplemental group in the set, a respective spray sheet breaking structure between the respective transition section of each downward-facing section in the group and the adjacent downward-facing section, each spray sheet breaking structure being capable of breaking a spray sheet climbing up the adjacent downward-facing section;

in one of the series of speed ranges, the boat hull's trim angle being between about 3.0° and about 6.0°.

2. The boat hull of claim 1 in which the boat hull's trim angle is between about 3.0° and about 6.0° in each of the series of successively higher speed ranges.

3. A boat comprising the boat hull of claim 1; the boat further comprising:

at least one engine that propels the boat bowward.

4. A boat hull assembly comprising:

a set of one or more hull bodies, each hull body having a lower surface; the lower surfaces of the hull bodies together including a sequence of groups, each including one or more downward-facing sections; the sequence including a lowermost group and one or more supplemental groups above the lowermost group;

the lower surfaces being shaped so that, in a first speed range, an initial one of the supplemental groups is the uppermost group contacting or below a water surface, and, in a series of successively higher speed ranges, successively lower groups are each the uppermost group contacting or below the water surface, the lowermost group being the uppermost group contacting or below the water surface in the highest of the series of speed ranges;

the lower surfaces together including:

for each supplemental group in a set of one or more of the supplemental groups, a respective outward facing transition section between each downward-facing section in the group and an adjacent downward-facing section in the group's next lower group, a respective outward facing transition section; and for at least one supplemental group in the set, a respective spray sheet breaking structure between the respective transition section of each downward-facing section in the group and the adjacent downward-facing section, each spray sheet breaking structure being capable of breaking a spray sheet climbing up the adjacent downward-facing section;

in one of the series of speed ranges, the hull assembly's trim angle being between 3.0° and 6.0°.

5. A boat hull comprising:

a hull body having a lower surface that includes a sequence of groups, each including one or more downward-facing sections; the sequence including a lowermost group and one or more supplemental groups above the lowermost group, each supplemental group including a port section and a starboard section, each port section and each starboard section being outward of its next lower downward-facing section;

the lower surface being shaped so that, in a first speed range, an initial one of the supplemental groups is the uppermost group contacting or below a water surface, and, in a series of successively higher speed ranges, successively lower groups are each the uppermost group contacting or below the water surface, the lowermost group being the uppermost group contacting or below the water surface in the highest of the series of speed ranges; the lower surface further including:

for each supplemental group in a set of one or more of the supplemental groups, a respective outward facing transition section between each downward-facing section in the group and an adjacent downward-facing section in the group's next lower group; and for at least one supplemental group in the set, a respective spray sheet breaking structure between the respective transition section of each downward-facing section in the group and the adjacent downward-facing section, each spray sheet breaking structure being capable of breaking a spray sheet climbing up the adjacent downward-facing section;

the boat hull being structured so that, when a lower group is the uppermost group contacting or below the water surface, the next higher group receives less spray than necessary to maintain its level of wetness.

6. The boat hull of claim 5 in which, in each water-contacting cross section, each port and starboard section from the initial supplemental group to the lowermost group has an outward angle above horizontal; the outward angles of each port and starboard section up to and including the initial supplemental group not decreasing from the next inward downward-facing section.

7. A boat hull comprising:

a hull body having a lower surface that is substantially port-starboard symmetrical in each water-contacting cross section; the lower surface including:

port and starboard sequences of planing sections on the port and starboard sides of the lower surface, respectively; each sequence including a central section and one or more supplemental sections outward of the central section; the port and starboard sequences including pairs of port and starboard planing sections including an initial pair of the supplemental sections that is the uppermost pair contacting or below a water surface when the boat hull is at rest under normal conditions and at least one pair inward of the initial pair that can be the uppermost pair contacting or below a water surface when the boat hull is moving bowward;

for each pair of port and starboard planing sections from the initial pair inward, a respective pair of port and starboard outward facing transition sections between the pair of planing sections' outer peripheries and a next outward pair of sections' inner peripheries; and for at least one of the pairs of planing sections from the initial pair inward, a pair of port and starboard spray sheet breaking structures between the pair of planing sections' outer peripheries and the respective transition sections; each spray sheet breaking structure being capable of breaking a spray sheet climbing up its next inward planing section;

the lower surface being shaped so that, as the boat hull accelerates bowward from rest under normal conditions, it successively rises through one or more stages after each of which the boat hull lifts off a pair of the planing sections that was the uppermost pair contacting or below the water surface during the stage and begins a next stage in which the next inward pair of planing sections is the uppermost pair contacting or below the water surface until a final stage in which the central sections are the uppermost pair contacting or below the water surface;

in each water-contacting cross section, each pair of supplemental sections from the initial pair inward having an outward angle that is above horizontal and is not smaller than the next inward pair's outward angle;

when the respective transition sections of a pair of the spray sheet breaking structures rise above the water surface, each spray sheet breaking structure in the pair breaking a spray sheet that climbs up its next inward planing section and preventing the broken spray sheet from climbing up the respective transition section.

8. A boat hull designed for a set of one or more displacement characteristics; the boat hull comprising:

a hull body having a lower surface that includes a sequence of groups, each including one or more downward-facing sections; the sequence including a lowermost group and one or more supplemental groups above the lowermost group;

the lower surface being shaped so that, in a first speed range, an initial one of the supplemental groups is the uppermost group contacting or below a water surface, and, in a series of successively higher speed ranges, successively lower groups are each the uppermost group contacting or below the water surface, the lowermost group being the uppermost group contacting or below the water surface in the highest of the series of speed ranges;

the lower surface further including:

for each supplemental group in a set of one or more of the supplemental groups, a respective outward facing transition section between each downward-facing section in the group and an adjacent downward-facing section in the group's next lower group, a respective outward facing transition section; and for at least one supplemental group in the set, a respective spray sheet breaking structure between the respective transition section of each downward-facing section in the group and the adjacent downward-facing section, each spray sheet breaking structure being capable of breaking a spray sheet climbing up the adjacent downward-facing section;

the lowermost group having a maximum width between its outer peripheries and a target maximum speed; the maximum width being approximately equal to an ideal beam width for the set of displacement characteristics and for the target maximum speed.

9. The boat hull of claim 8 in which the set of displacement characteristics includes total displacement.

10. The boat hull of claim 8 in which the set of displacement characteristics includes a length from the lowermost group's aft end to the boat hull's center of gravity.

11. The boat hull of claim 8 in which the lowermost group includes only one downward-facing section.

12. A boat hull comprising:

a hull body having a lower surface that is substantially port-starboard symmetrical about a central plane in each water-contacting cross section; the lower surface including:

port and starboard sequences of planing sections on the port and starboard sides of the central plane, respectively; each sequence including a central section and one or more supplemental sections outward of the central section;

between each pair of next inward and next outward planing sections on port and starboard sides, a respective outward-facing transition section that is approximately vertical, that meets the next inward planing section's outer periphery at a respective chine, and that has, in each cross section, a height from the chine to the next outward planing section's inner periphery; in each cross section from the boat hull's stem to approximately amidship, the height being approximately a constant height H, where H is at least approximately 0.00595 $L_p$ and where $L_p$ is the chine's length measured in the same units as H; and for the transition sections of at least one of the pairs of next inward planing sections, a respective pair of port and starboard spray sheet breaking structures along the respective chines; each spray sheet breaking structure being capable of breaking a spray sheet climbing up its next inward planing section;

the lower surface being shaped so that, as the boat hull accelerates bowward from rest under normal conditions, an initial pair of the supplemental sections is the uppermost pair contacting or below a water surface and then the boat hull successively lifts off each pair of planing sections so that their next inward pair of planing sections is the uppermost pair contacting or below the water surface until the central sections are the uppermost pair contacting or below the water surface; in each water-contacting cross section, each port and starboard planing section from the initial pair to the central section having an outward angle that is above horizontal and is not smaller than the next inward planing section's outward angle;

the outward angles of the planing sections and the heights of the transition sections further being such that each pair of supplemental planing sections receives less spray than necessary to maintain its level of wetness when its next inward pair of planing sections is the uppermost group contacting or below the water surface under normal conditions.

13. A boat hull comprising:

a hull body having a lower surface that includes:

a sequence of groups, each including one or more downward-facing sections; the sequence including a lowermost group and one or more supplemental groups above the lowermost group, each supplemental group including a port section and a starboard section, each port section and each starboard section being outward of its next lower downward-facing section;

between each pair of next inward and next outward downward-facing sections on port and starboard sides, a respective outward-facing transition section that extends from the next inward downward-facing section's outer periphery to the next outward downward-facing section's inner periphery; each transition section meeting the next inward downward-facing section's outer periphery at a respective chine; and on each transition section, a spray strip along its chine;

the lower surface being shaped so that, in a first speed range, an initial one of the supplemental groups is the uppermost group contacting or below a water surface, and, in a series of successively higher speed ranges, successively lower groups are each the uppermost group contacting or below the water surface, the lowermost group being the uppermost group contacting or below the water surface in the highest of the series of speed ranges;

the boat hull being structured so that, when a lower group is the uppermost group contacting or below the water surface, the next higher group receives less spray than necessary to maintain its level of wetness.

14. A boat hull comprising:

a hull body having a lower surface that is substantially port-starboard symmetrical about a central plane in each water-contacting cross section; the lower surface including:

a sequence of pairs of port and starboard planing sections on the port and starboard sides of the central plane, respectively; the sequence including a central pair and one or more supplemental pairs outward of the central pair; each pair in the sequence having a respective maximum beam width between its outer peripheries; and between each pair of next inward and next outward planing sections on port and starboard sides, a respective outward-facing transition section that meets the next inward planing section's outer periphery at a respective chine and that has, in each cross section, a height from the chine to the next outward planing section's inner periphery; and for the transition sections of at least one of the pairs of next inward planing sections, a respective pair of port and starboard spray sheet breaking structures along the respective chines; each spray sheet breaking structure being capable of breaking a spray sheet climbing up its next inward planing section;

the lower surface being shaped so that, as the boat hull accelerates bowward from rest under normal conditions, an initial one of the supplemental pairs is the uppermost pair contacting or below a water surface and then the boat hull makes at least one transition in which it lifts off a supplemental pair that is the uppermost pair contacting or below the water surface so that their next inward pair of planing sections is the uppermost pair contacting or below the water surface until the central sections are the uppermost pair contacting or below the water surface, the boat hull making each transition in response to lift from pairs of planing sections lower than the supplemental pair that is the uppermost pair contacting or below the water surface;

each pair of planing sections inward from the initial supplemental pair to the central pair having a maximum beam width between the chines at its outer periphery, the maximum beam width being narrower than the hull body's maximum width; the chines of each pair of planing sections inward from the initial supplemental pair forming a chine line that begins where the chines' respective transition sections intersect at the boat hull's bow and extends rearward on both port and starboard sides, all the chine lines having approximately the same shape, the chine lines having increasing length-beam ratios from the initial supplemental pair inward.

15. A boat hull comprising:

a hull body having a lower surface, the lower surface including:

a sequence of groups, each including one or more downward-facing sections; the sequence including a lowermost group and one or more supplemental groups above the lowermost group, each supplemental group including a port section and a starboard section, each port section and each starboard section being outward of its next lower downward-facing section; the groups including an initial one of the supplemental groups that is the uppermost group contacting or below a water surface when the boat hull is at rest under normal conditions and at least one group lower than the initial group that can be the uppermost group contacting or below a water surface when the boat hull is moving bowward; in each water-contacting cross section, each port and starboard section from the initial supplemental group downward having an outward angle above horizontal from a lower periphery to an upper periphery;

for each group from the initial group downward, a respective pair of port and starboard outward facing transition sections between upper peripheries of the group and lower peripheries of port and starboard sections of a next outward group, the transition sections being approximately vertical; and for at least one of the groups from the initial group downward, a pair of port and starboard spray sheet breaking structures between the group's upper peripheries and the respective transition sections; each spray sheet breaking structure being capable of breaking a spray sheet climbing up its next lower downward-facing section;

the lower surface being shaped so that, in a first speed range, the initial group is the uppermost group contacting or below a water surface, and, in each of a series of one or more successively higher speed ranges, a respective successively lower group is the uppermost group contacting or below the water surface; at the upper end of each speed range except a highest speed range, the boat hull lifting off a group that was the uppermost group contacting or below the water surface in the speed range;

when the boat hull lifts the respective transition sections of a pair of the spray sheet breaking structures above the water surface, each spray sheet breaking structure in the pair breaking a spray sheet that climbs up its next lower downward-facing section and preventing the broken spray sheet from climbing up the respective transition section.

16. The boat hull of claim 15 in which each transition section meets the next lower downward-facing section's upper periphery at a respective chine.

17. The boat hull of claim 16 in which each spray sheet breaking structure is a spray strip along one of the chines.

18. The boat hull of claim 16 in which each transition section includes a vertical section having, in each cross section, a height between the next lower downward-facing section's upper periphery and the next upward downward-facing section's lower periphery; in each cross section from the boat hull's stern to approximately amidship, the height being approximately a constant height H, where H is at least approximately 0.00595 $L_p$ and where $L_p$ is the chine's length measured in the same units as H.

19. The boat hull of claim 18, further comprising, for each transition section's vertical section, a longitudinal frame member supporting the vertical section.

20. The boat hull of claim 15 in which at least one of the supplemental groups is the uppermost group contacting or below the water surface at a cruising speed below the highest of the series of speed ranges.

21. A boat comprising:

a hull assembly; and a set of one or more engines that can propel the boat bowward in any of a series of speed ranges;

the hull assembly including:

a set of one or more hull bodies, each hull body having a lower surface; the lower surfaces of the hull bodies together including a sequence of groups, each including one or more downward-facing sections; the sequence including a lowermost group and one or more supplemental groups above the lowermost group;

the lower surfaces being shaped so that, in a first speed range in the series, an initial one of the supplemental groups is the uppermost group contacting or below a water surface, and, in successively higher speed ranges in the series, successively lower groups are each the uppermost group contacting or below the water surface, the lowermost group being the uppermost group contacting or below a water surface in the highest of the series of speed ranges; the lower surfaces together including:

for each supplemental group in a set of one or more of the supplemental groups, a respective outward facing transition section between each downward-facing section in the group and an adjacent downward-facing section in the group's next lower group; and for at least one supplemental group in the set, a respective spray sheet breaking structure between the respective transition section of each downward-facing section in the group and the adjacent downward-facing section, each spray sheet breaking structure being capable of breaking a spray sheet climbing up the adjacent downward-facing section;

the boat having displacement characteristics so that, in each of the successively higher speed ranges under normal conditions, the hull assembly's unadjusted trim angle remains between about 3.0° and about 6.0°.

22. The boat of claim 21 in which, in one of the speed ranges, the hull assembly's unadjusted trim angle is between about 3.5° and about 5.5°.

23. The boat of claim 22 in which, in the one speed range, the hull assembly's unadjusted trim angle is between about 4.0° and about 5.0°.

24. The boat of claim 21 in which the set of hull bodies includes only one hull body.

25. The boat of claim 24 in which the one hull body's length is greater than its width.

26. The boat of claim 24 in which the one hull body has port and starboard sides; the lowermost group including a central downward-facing section, each supplemental group including port and starboard supplemental downward-facing sections outward from the central downward-facing section's port and starboard outer peripheries, respectively.

27. The boat of claim 26 in which the one hull body is substantially port-starboard symmetrical in each water-contacting cross section.

28. The boat of claim 26 in which the downward-facing sections extend lengthwise.

29. The boat of claim 26 in which, in each water-contacting cross section, each of the downward-facing sections is substantially linear.

30. The boat of claim 29 in which, in each water-contacting cross section, the central downward-facing section is V-shaped.

31. The boat of claim 21 in which the sequence includes only one of the supplemental groups.

32. The boat of claim 21 in which the sequence includes three supplemental groups of downward-facing sections.

33. The boat of claim 21 in which at least one of the supplemental groups is the uppermost group contacting or below the water surface at a cruising speed below the highest of the series of speed ranges.

34. A method of operating the boat of claim 21, comprising:

operating the set of engines to accelerate the boat bowward from rest; the act of operating the set of engines comprising:

accelerating the boat from rest to a first speed at which the initial one of the supplemental groups is the uppermost group contacting or below the water surface; and accelerating the boat from the first speed to a second speed at which the lowermost group is the uppermost group contacting or below the water surface; in accelerating from the first speed to the second speed, the boat hull assembly passing through at least one transition from one of the supplemental groups being the uppermost group contacting or below the water surface to their next lower group being the uppermost group contacting or below the water surface.

* * * * *